United States Patent [19]

Ragge, Jr.

[11] Patent Number: 4,886,994

[45] Date of Patent: Dec. 12, 1989

[54] SNAP-IN LIGHT BULB

[76] Inventor: Albert J. Ragge, Jr., 760 Plain St., Bldg. 22, Apt. 12, Marshfield, Mass. 02050

[21] Appl. No.: 265,494

[22] Filed: Nov. 1, 1988

[51] Int. Cl.[4] ..... H01J 5/60

[52] U.S. Cl. ..... 313/318; 313/316; 313/317; 439/611

[58] Field of Search ..... 313/316, 317, 318, 220; 439/611, 612, 613, 615, 616, 617, 619

[56] References Cited

U.S. PATENT DOCUMENTS

| | | | |
|---|---|---|---|
| 4,201,438 | 5/1980 | Shea | 313/318 |
| 4,473,770 | 9/1984 | Baba et al. | 313/318 |
| 4,595,859 | 6/1986 | Steiner et al. | 313/317 |
| 4,603,278 | 7/1986 | Devir et al. | 313/318 |
| 4,724,353 | 2/1988 | Devir | 313/318 |
| 4,791,335 | 12/1988 | Lin | 313/318 |

*Primary Examiner*—Leo H. Boudreau
*Assistant Examiner*—Michael Razavz
*Attorney, Agent, or Firm*—Fish & Richardson

[57] ABSTRACT

A snap-in light bulb having a bulb through which light may be transmitted, a base connected to the bulb, and at least one arm resiliently connected to the base. The arm has a conductor element disposed for contact with a conductive light bulb socket and a plurality of spaced lobes that engage the socket threads. A system including a pole for light bulb insertion is also described.

8 Claims, 1 Drawing Sheet

SNAP-IN LIGHT BULB

BACKGROUND OF THE INVENTION

The present invention relates to light bulbs haivng threaded bases.

Conventional light bulbs utilize conductive bases which are screwed into corresponding conductive sockets. A portion of the light bulb base is electrically separate from the remainder of the base and is utilized to ground the circuit.

Other types of light bulbs, e.g., Christmas tree light bulbs, may be plugged into a socket specifically designed to accommodate the light bulb, i.e., the socket has a specific size and the conductor portions are specifically designed to receive corresponding conductor portions from the plug-in light bulb.

SUMMARY OF THE INVENTION

It has been discovered that providing a light bulb with at least one arm resiliently connected to its base and having a conductive element and lobe portions that mate with threads of a conventional light socket allows the bulb to be advantageously snapped into a conventional light socket.

According to the invention, a snap-in light bulb comprises a bulb through which light may be transmitted, a base connected to the bulb, and at least one arm resiliently connected to the base, the arm comprising a conductor element disposed for contact with a conventional conductive light bulb socket, the element in electrical contact with the base, the arm having a plurality of spaced lobe portions, the lobe portions being configured to mate with corresponding threads of the conventional light bulb socket, the arm adapted to be engaged for resilient movement toward the base, allowing a clearance between the plurality of lobe portions and the threads of the conventional light bulb socket such that the base may be inserted axially into the conventional light socket, and the arm adapte to move resiliently outward thereby to engage the lobes in the corresponding threads of the conventional light bulb socket.

In preferred embodiments the light bulb includes a plurality of arms; the base has a recess into which the arm fits when the bulb is inserted into the light socket; the arm and the base define a gap into which the arm may be moved to allow the lobe portions to disengage the socket; the base is conductive; and an insulator is contiguous to a portion of the conductive element.

According to another aspect of the invention, a system for inserting and removing a light bulb comprises a pole, removal arms disposed on one end of the pole, the removal arms being adapted to engage a light bulb arm which is resiliently connected to a light bulb base, and an actuating mechanism, the actuating mechanism actuating the removal arms, wherein, actuating the actuating mechanism causes the removal arms to engage the light bulb thereby allowing the light bulb to be inserted into or removed from a light bulb socket without twisting the light bulb.

Preferred embodiments of this aspect of the invention may include the light bulb described above.

DETAILED DESCRIPTION OF THE EMBODIMENT

The drawings are first briefly described. Drawings

STRUCTURE

Figure 1:
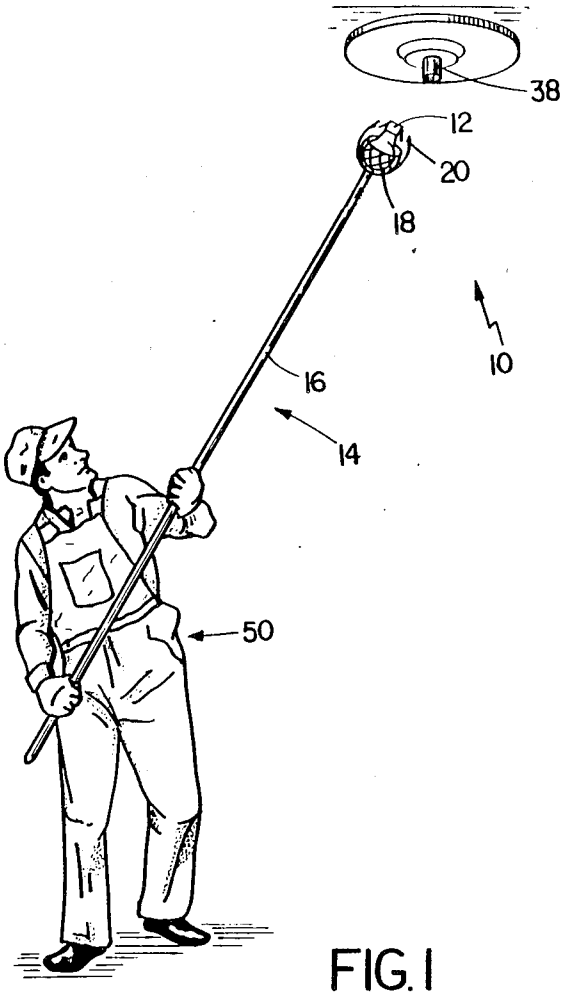
FIG. 1 shows a light bulb insertion system according to the invention.

Referring to FIG. 1, light bulb insertion and removal system 10 includes snap-in light bulb 12 and insertion and removal member 14. Insertion and removal member 14 includes variable height adjustable pole 16, netting 18, an actuating mechanism (not shown) and removal arms 20.

Figure 3:
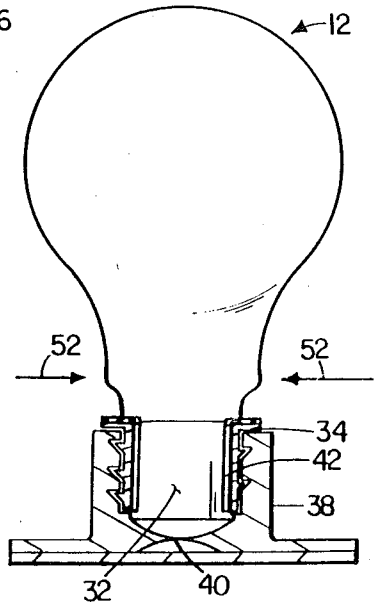
FIG. 3 shows a cross-sectional view along the lines 3—3 of the FIG. 2 light bulb.

Referring to FIGS. 3 and 3, snap-in light bulb 12 includes glass bulb 30, containing a filament (not shown) and base 32. Resiliently attached to base 32 are arms 34. Base 32 and arms 34 are constructed of conductive material, e.g., copper or copper alloy, brass or brass alloy, gold or gold alloy. Arms 34 are constructed with lobe portions 36 which correspond to the threads of conventional socket 38. Arms 34 extend outwardly, e.g. at an angle to the axis of the bulb, when not within socket 38 and fit within recesses 39 when the bulb is snapped into socket 38. Base 32 includes electrical ground portion 40 which is electrically separate from arms 34. Arms 34 are connected to base 32, e.g. at a 90° angle, an define gap 42 between arms 34 and base 32 when snapped into socket 38. Arms 34 include insulator 44, e.g., constructed of flexible rubber, attached to the ends of arms 34.

Operation

Referring to FIG. 1, worker 50 may utilize light bult insertion system 10 to isnert a snap-in bulb 12 as described above into socket 38, which is beyond his reach. Upon insertion, base 32 is aligned with socket 38 and bulb is simply snapped in, as the arms 34 are compressed towards base 32, e.g. by pressing the arms inwardly (as shown by arrows 52) or by simply pressing the bulb axially into the socket, placing base 32 within socket 38. The arms 34 compress resiliently toward base 32, so there is not need to screw light bulb 12 into socket 38, and, within the socket, the arms spread resiliently to cause the lobe portions 36 to mate with corresponding theads of the socket.

For removal, arms 34 are simply compressed in the direction shown by arrows 52, or, if light bulb 12 is out of the reach of operator 50, removal arms 20 of insertion and removal member 14 are actuated by operator 50 to compress arms 34. By compressing arms 34 in this way, lobe portions 36 are disengaged from the threads of socket 38. Thus, snap-in light bulb 12 may be removed without unscrewing it from socket 38. Netting 18 is provided in insertion and removal member 14 to catch light bulb 12 after it is removed from socket 38; additionally, netting 18 with a disposable plastic liner may be used to protect operator 50 if light bulb 12 shatters.

Other Embodiments

Other embodiments are within the following claims. For example, arms 34 may be connected to base 32 at some other angle, e.g. a 45° angle. Removal arms 20 may be actuated in a plurality of ways, e.g., by using tongs located at the opposite end of pole 16, by using a string connected to removal arms 20, or by using a twisting mechanism which actuates arms 20. There may be more than one or two arms 34 attached to base 32, e.g., there may be four equally spaced arms 34. The plurality of arms 34 may be constructed of a single piece of resilient material having an aperture through which the ground of base 32 is reached; this single unit is then attached to base 32 around groudn 40 and the arms are bent into individual recesses 39.

Base 32 may also be undersized with respect to socket 38 so that there is no need to provide recesses 38 into which arms 34 fit when base 32 is snapped into socket 38, and the bulb may be provided with, e.g., a flange to restrict access to the gap betwen base and socket.

I claim:

1. A snap-in light bulb for use in combination with a conventional, threaded light bulb socket having a generally cylindrical inner wall of electricity-conductive mateial defining a light bulb base-receiving orifice, and further defining a generally helical thread extending about the inner wall surface, said snap-in light bulb comprising:

a bulb through which light may be transmitted, a light bulb base connected to said bulb, and at least one arm resiliently connected to said light bulb base, said arm comprising an electrical conductor element disposed for electricity-conducting contact with the inner wall surface of the conventional, threaded light bulb socket, said element in electrical contact with said light bulb base, said arm having a plurality of spaced-apart lobe portions, said lobe portions configured and arranged for engagement about the generally helical thread of the conventional light bulb socket in a manner to maintain said light bulb disposed fixedly within the socket, said arm adapted for resilient movement toward said light bulb base, thereby to provide clearance between said plurality of lobe portions and the inner wall surface of the conventional light bulb socket such that said light bulb may be inserted axially into the conventional light bulb socket, and said arm adapted for resilient movement toward said light bulb base, thereby to provide clearance between said plurality of lobe portions and the inner wall surface of the conventional light bulb socket such that said light bulb may be inserted axially into the conventional light bulb socket, and said arm adapted to move resiliently outward thereby to engage said lobes about the thread of the conventional light bulb socket to hold said light bulb in the socket, and said arm adapted to permit said light bulb to be removed axially from the conventional light bulb socket.

2. The snap-in light bulb of claim 1 further comprising a plurality of arms.

3. The snap-in light bulb of claim 1 wherein said light bulb base defines a recess, and said arm fits into said recess when said arm is engaged to mvoe toward said base.

4. The snap-in light bulb of claim 1 wherein said light bulb base and said arm define a gap when said base is inseted axially into the conventional light bulb socket, said gap allowing said arm to be engaged to move toward said base, thereby disengaging said lobes from the inner wall of the conventional light bulb socket to allow said light bulb to be removed from the socket without unscrewing said light bulb.

5. The snap-in light bulb of claim 4 wherein said light bulb base is conductive.

6. The snap-in light bulb of claim 1 further comprising an insulator contiguous to a portion of said conductor element thereby providing an area which may be engaged which is not electrically conductive.

7. A system for inserting and removing a light bulb froma conventional, threaded light bulb socket having a generally cylindrical inner wall of electricity-conductive material defining a light bulb base-receiving orifice, and further defining a generally helical thread extending about the inner wall surface, said system comprising:

a pole, removal arms disposed on one end of said pole, and an actuating mechanism, said actuating mechanism actuating said removal arms, wherein, actuating said actuating mechanism causes said removal arms to engage said light bulb thereby allowing said light bulb to be isnerted into or removed form a light bulb socket without twisting said light bulb, said light bulb being a snap-in light bulb for use in combination with said conventional, threaded light bulb socket, said snap-in light bulb comprising:

a bulb through which light may be transmitted, a light bulb base connected to said bulb, and at least one arm resiliently connected to said light bulb base, said arm comprising an electrical conductor element disposed for electricity-conducting contact with the inner wall surface of the conventional, threaded light bulb socket, said element in electrical contact with said light bulb base, said arm having a plurality of spaced-apart lobe portions, said lobe portions configured and arranged for engagement about the generally helical thread of the conventional light bulb socket in a manner to maintain said light bulb disposed fixedly within the socket, said arm adapted for resilient movement toward said light bulb base, thereby to provide clearance between said plurality of lobe portions and the inner wall surface of the conventional light bulb socket such that said light bulb may be inserted axially into the conventional light bulb socket, and said arm adapted to move resiliently outward thereby to engage said lobes about the thread of the conventional light bulb socket to hold said light bulb in the socket.

8. The snap-in light bulb of claim 7 wherein said arms are adapted to permit said light bulb to be removed axially from the conventional light bulb socket.

* * * * *

UNITED STATES PATENT AND TRADEMARK OFFICE

CERTIFICATE OF CORRECTION

PATENT NO. : 4,886,994

DATED : December 12, 1989

INVENTOR(S) : Albert J. Ragge, Jr.

It is certified that error appears in the above-identified patent and that said Letters Patent is hereby corrected as shown below:

Missing Prior Art:

| | | | |
|---|---|---|---|
| 3,541,381 | 11/70 | Matsuya | 313/315 |
| 4,146,814 | 3/79 | Wojtowicz | 313/320 |
| 4,032,774 | 6/77 | Spicer | 240/73 |

Col. 1, line 5, "haivng" should be --having--.

Col. 1, line 41, "adapte" should be --adapted--.

Figure 2:
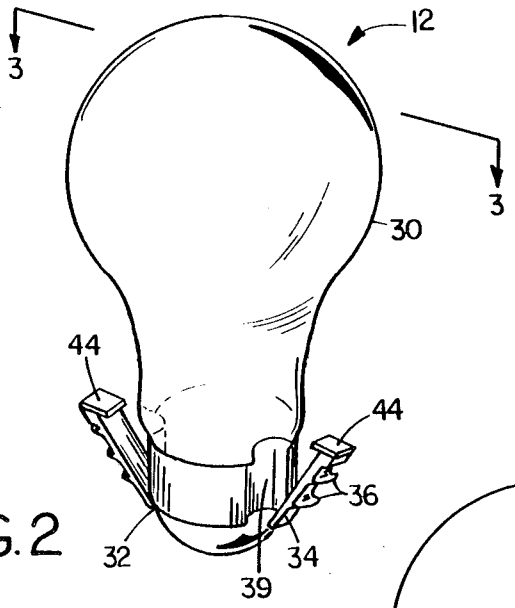
FIG. 2 shows a perspective view of a snap-in light bulb of the FIG. 1 system.

Col. 2, line 15, "FIGS. 3 and 3," should be --FIGS. 2 and 3,--.

Col. 2, line 28, "an define" should be --and define--.

Col. 2, line 34, "bult" should be --bulb--.

Col. 2, line 35, "isnert" should be --insert--.

Col. 2, line 43, "not" should be --no--.

Col. 2, line 46, "theads" should be --threads--.

Col. 3, line 5, "groudn" should be --ground--.

Col. 3, line 8, "recesses 38" should be --recesses 39--.

Col. 3, line 11, "betwen" should be --between--.

Col. 3, line 16, "mateial" should be --material--.

Col. 3, line 62, "mvoe" should be --move--.

UNITED STATES PATENT AND TRADEMARK OFFICE

CERTIFICATE OF CORRECTION

PATENT NO. : 4,886,994

DATED : December 12, 1989

INVENTOR(S) : Albert J. Ragge, Jr.

It is certified that error appears in the above-identified patent and that said Letters Patent is hereby corrected as shown below:

Col. 4, line 2, "inseted" should be --inserted--.

Col. 4, line 16, "froma" should be --from a--.

Col. 4, line 28, "isnerted" should be --inserted--.

Col. 4, line 29, "form" should be --from--.

Signed and Sealed this

Twenty-third Day of October, 1990

*Attest:*

HARRY F. MANBECK, JR.

*Attesting Officer*

*Commissioner of Patents and Trademarks*